US006009946A

United States Patent [19]

McKelvey

[11] Patent Number: 6,009,946

[45] Date of Patent: Jan. 4, 2000

[54] DEVICE FOR SEALING CHARGES IN SHOT HOLES AND A METHOD FOR USING THE SAME

[75] Inventor: Robert E. McKelvey, Palestine, Tex.

[73] Assignee: Exploration Products Company, LLC, Palestine, Tex.

[21] Appl. No.: 08/970,374

[22] Filed: Nov. 14, 1997

[51] Int. Cl.[7] ..... E21B 33/13

[52] U.S. Cl. ..... 166/286; 166/287; 166/293

[58] Field of Search ..... 166/279, 285, 166/292, 293, 300; 175/65, 72

[56] References Cited

U.S. PATENT DOCUMENTS 3,918,523 11/1975 Stuber .
3,946,569 3/1976 Stuber .
4,267,062 5/1981 Byerley ..... 166/305.1 X
4,278,025 7/1981 McReynolds .
4,936,386 6/1990 Colangelo .
5,041,330 8/1991 Heerten et al. .
5,476,142 12/1995 Kajita ..... 166/294
5,611,400 3/1997 James et al. ..... 166/293
5,657,822 8/1997 James et al. ..... 166/292

*Primary Examiner*—Roger Schoeppel
*Attorney, Agent, or Firm*—Jackson Walker, LLP

[57] ABSTRACT

A device and its method of application is described for inserting into a shot hole which is at least partially filled with a mud suspension, the device being enclosed by a cover soluble in the mud and containing an expandable material capable of expanding upon contact with the mud and forming a plug which is capable of sealing the borehole, to include apparatus allowing the plug container to be retrieved from the borehole.

12 Claims, 3 Drawing Sheets

DEVICE FOR SEALING CHARGES IN SHOT HOLES AND A METHOD FOR USING THE SAME

FIELD OF THE INVENTION

A method for sealing charges in drilled shot holes and a device for utilization with the method. More specifically, a method for sealing charges in a drilled shot hole in which is provided a container carrying an expandable material wrapped in a composition soluble in the mud suspension of the shot hole, which container is inserted into the shot hole after the charge is placed, the soluble composition dissolving and reaction between the expandable material and mud suspension causing the expandable material to expand outward to the walls of the shot hole, effectively plugging the shot hole.

BACKGROUND OF THE INVENTION

Oil or gas exploration often utilizes seismic analysis. Shot holes are drilled into the earth and a charge is placed in the shot hole, usually at the bottom. Detonation of the charge sets up shock waves in the surrounding earth. Instruments, typically located on the earth's surface about the shot hole, analyze the pattern of the seismic shock waves to determine underground formation structure and the potential for the presence of oil or gas.

Applicant's invention provides a new and improved method and device for sealing charges at the bottom of shot or bore holes. The present invention overcomes a problem sometimes found in conventional methods of plugging shot holes which use loosely poured bentonite, a substance that will swell when absorbing water. Typically, during the drilling process, water, dirt, and drilling lubricants, form a thick, muddy solution filling the shot hole. Most effective sealing methods would seal the charge directly above the charge at the bottom of the shot hole to allow optimum downward and outward energy dispersion when the charge is detonated. However, loosely poured bentonite and other clays are often unable to penetrate to the necessary depths to seal the charge.

Applicant's method begins with providing a container which is comprised of an expandable material, such as bentonite or a mixture of bentonite and other clays, wrapped in a water based mud suspension-soluble material, such as starch paper. The container is typically coated with vegetable oil to delay dissolution of the starch paper until the container reaches the bottom of the bore hole. The coated container is then dropped into the shot hole. Upon dissolution of the paper, the expandable material reacts with the mud suspension and expands against the walls of the shot hole. In this manner, it effectively traps the charge between the plug that is formed by the expanded clay and the bottom of the shot hole. When the charge is then detonated, the plug helps contain the energy of the detonation so more energy is concentrated downward and outward for more effective seismic readings.

OBJECTS OF THE INVENTION

It is an object of the present invention to provide for an effective method of sealing a charge at the bottom of a shot hole, the method including a novel container made up of liquid-absorbing, expandable material, such as bentonite, encased in a tubular or cylindrical container and covered with a biodegradable, water-soluble material and, when necessary, coated with vegetable-based oils.

It is a further object of the present invention to provide for a container that will penetrate the water drilling fluids or mud of a shot hole and sink to the bottom of the bore holes to swell and seal off the bore holes.

It is a further object of the present invention to provide for a system to deliver a bentonite-filled container to a predetermined depth in a shot hole.

It is a still further object of the present invention to provide for a system that is reusable and that will place both a charge and a bentonite-filled container at a predetermined depth in a shot hole.

SUMMARY OF THE INVENTION

Applicant's method, designed to meet the foregoing objectives and others, includes providing a container carrying an expandable material and wrapped in a composition soluble in a mud suspension and locating the container at the bottom of a shot hole by releasing it into the shot hole and allowing for the dissolution of the covering of the container and expansion of the expandable material when the container reaches the bottom of the shot hole.

Applicant's method also provides a novel device, the device for inserting into the shot hole consisting of a plug made up of material capable of expanding on contact with the mud solution of the shot hole, the material being enclosed by a cover, the cover which is soluble in the mud suspension and which cover is, optionally, covered with oil or another agent designed to retard the dissolution of the cover.

Applicant's novel method includes a novel device for delivering the plug and the charge to a preselected location in the shot hole, the device retrievable from the shot hole.

These and other objects are provided for in a system for inserting into a shot hole drilled into the surface of the earth, the system including a device comprising a plug made of a material that will, upon contact with the mud suspension of the shot hole, expand to seal the shot hole. The system further includes a container dimensioned to receive the plug which will deposit the plug at a preselected location in the shot hole, which is capable of being retrieved by the user, and which also includes means to fix an explosive charge in the hole when the container carrying an explosive charge starts to be removed from the hole.

DETAILED DESCRIPTION OF THE PREFERRED EMBODIMENT

Figure 1A:
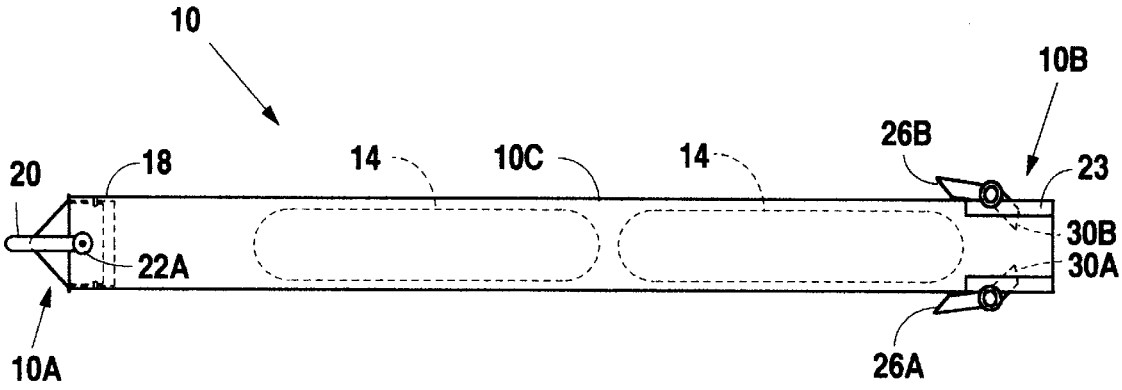
FIGS. 1A and 1B are side elevational views of components of Applicant's present invention.

FIGS. 1A through 1D illustrate components of Applicant's delivery system (10), the system for delivering into a bore hole or shot hole drilled into the earth and at least partially filled with a fluid including a muddy-water suspension (A), a dynamite charge (C). Applicant's delivery system is seen to include two main components, a tube loader (12) containing therein water-soluble plug or tubes (14) and an anchor charge (16) to which is engaged a dynamite charge (C).

The tube loader is typically cylindrical usually between 2 and 4 inches in diameter and 24 and 60 inches long, made of stainless steel, hollow, and having a first end (10A) and a second end (10B) and a body (10C) therebetween. The body is hollow and the ends are open. The hollow body is dimensioned to receive therein cylindrical water-soluble tubes (14) in the manner set forth in more detail below.

Figure 2A:
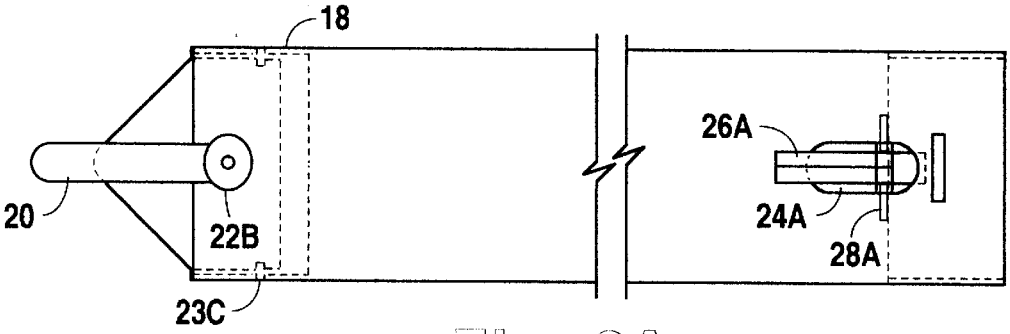
FIG. 2A is a side elevational view of the tube loader of Applicant's present invention.
Figure 2B:
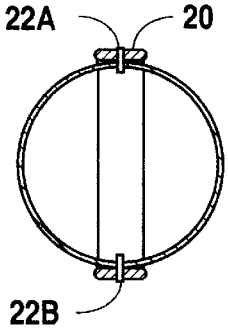
FIG. 2B is a top elevational view of the tube loader of Applicant's present invention.
Figure 2C:
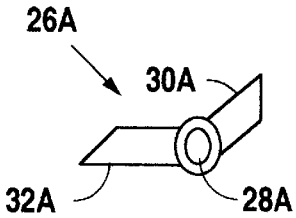
FIGS. 2C and 2D are side and top elevational views of the pawls of Applicant's present invention removed from the tube.
Figure 2D:
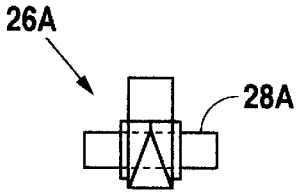
Figure 2E:
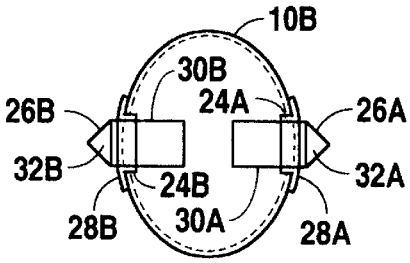
FIG. 2E is a bottom elevational view of the tube of Applicant's present invention illustrating the pawls in a position to maintain tubes within the body of the tube loader.

First end (10A) of tube loader (12) is seen to have a 2 inch steel strength band for reinforcement and also to have a pivoting handle (20) articulating at pins (22A) and (22B) (see also FIGS. 2A and 2B). The handle is pivotally mounted to the first end so that it can rotate out of the way to allow the loading of water-soluble tubes (14). A cable (not shown) is typically attached to handle (20) to lower the unit into a bore hole or shot hole. A removable, conical shaped cap is placed on the first end to allow for smooth removal after deposition of the charge in the hole to protect for the tube filling up with mud on retrieval. The cap has a hole in the top to release any vacuum.

Turning now to second end (10B) of tube loader (12) and with reference to FIGS. 1A, 2A, 2C, 2D, and 2E, it is seen that the second end, like the first end, has a 2 inch strength band (23), typically steel, welded to it. Further, the second end is seen to have two slots (24A) and (24B) cut through the walls of the body of the tube loader, the slots generally rectangular and opposite one another. In each slot is rotatably-mounted pawls (26A) and (26B) on mounting pins (28A) and (28B) such that the pawls can rotate with respect to the tube about the pins. Pawls (26A) and (26B) are constructed of two identically dimensioned arms that meet at the pins at an angle between 90° and about 160°. The two arms include tube-engaging arms (30A) and (30B) and bore hole or shot hole wall-engaging arms (32A) and (32B). The pawls are mounted in their respective windows such that the tubeengaging arms are inside the hollow body of tube loader (12) and the bore hole wall-engaging arms are mostly outside of the tube loader body, as best seen in FIG. 1A.

It can be seen with reference to FIG. 1A how the pawls operate to maintain tubes (14) within hollow body (10C) of tube loader (12) during descent of tube loader (12) down a shot hole. In looking at FIG. 1A, simply rotate the figure 90° so second end (10B) is down and first end (10A) is up. It can be seen that, if the tube loader diameter is slightly smaller than the diameter of the shot hole into which it descends, the wall-engaging arms of the pawls will be held in the position illustrated in FIG. 1A by contact and interference with the walls of the shot hole as the tube descends through the mud and fluid of the shot hole. Moreover, it is seen that, when the pawls are held in such a position, tube-engaging arms (30A) and (30B) will extend partially across the interior to prevent water-soluble tubes (14) from falling through the second end of the tube loader. It can be appreciated with reference to FIG. 1A that, as tube loader (12) is withdrawn from the hole (by means of a cable attached to handle (20)), wall-engaging arms (32A) and (32B), which have pointed tips (see FIG. 2C), will "grab" the walls of the bore hole or shot hole and rotate almost 180°, which will rotate the tube-engaging arms in an "out-of-the-way" position, which will allow tubes (14) to slide through the open second end of the tube loader. Thus, when the descent of the tube loader reaches its proper location in the bore hole or shot hole, descent can be reversed and, as the tube loader is pulled out, the pawls pivot, allowing one or more tubes (14) to slide out of the second end of the tube loader.

Figure 1B:
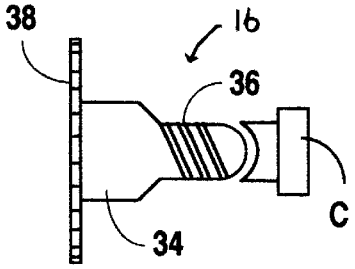
Figure 1C:
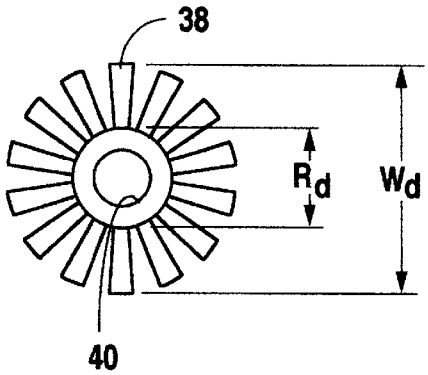
FIG. 1C is a rear elevational view of the anchor charge of Applicant's present invention.
Figure 1D:
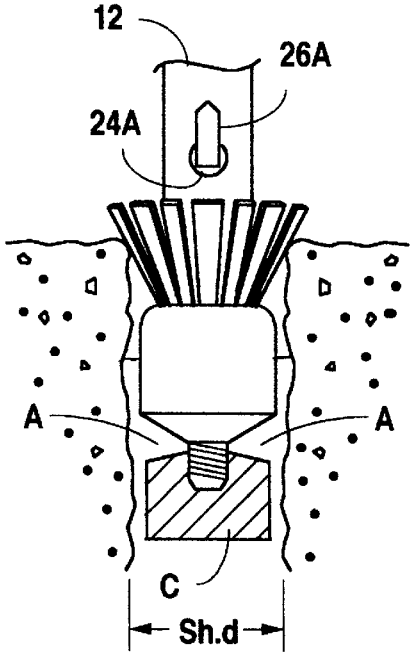
FIG. 1D is a side elevational view illustrating Applicant's present invention being inserted into a shot hole.

Turning now to details of anchor charge (16) and with reference to FIGS. 1B, 1C, and 1D, it is seen that the anchor charge is comprised of a body (34) having a threaded nose (36) at one end thereof for receipt of a dynamite charge thereon and a multiplicity of pliably or pivotally mounted wings (38) about a ring (40) on a second end of the body. The body is typically made of molded plastic and is intended to stay within the shot hole when the tube loader is removed therefrom. The wings have a natural position that allows them to stand approximately perpendicular to the longitudinal axis of the body (as set forth in FIG. 1B) but are pliable so they can be bent back when the device enters the shot hole (as illustrated in FIG. 1D). It is seen that the wing diameter (Wd) (see FIG. 1C) is typically 8", which is typically greater than shot hole diameter (Sh.d), typically about 4" as illustrated in FIG. 1D. Further, ring diameter (Rd) is typically about the same diameter as the tube body so that the tube body can nest within or adjacent ring (40) for insertion into the shot hole as set forth in FIG. 1D. Since the wing diameter is larger than the shot hole diameter, the wings get bent back when anchor charge (16) engages the shot hole. Further, when tube loader (12) containing tubes (14) therein is placed against the anchor charge body (34), its weight will be sufficient to overcome the friction between wings (38) and the side walls of the shot hole and, under the weight of charge (C), anchor charge (16) and, mainly, tube loader (12) with tubes (14) therein, the whole unit will sink through the mud and water of the shot hole in the position set forth in FIG. 1D (wings bent back). Further, it can be seen that the interference of the wings against the side walls will allow a one-way trip—downward—through the shot hole, and will tend to prevent backing up, where the tips of the wings would catch the edge of the side walls of the shot hole.

Thus, it is seen how the combination of tube loader (12) with water-soluble tubes therein and anchor charge (16) can be used to place a charge at a preselected location in a shot hole and, when the tube loader is pulled out, to deposit tube or tubes (14) on top of anchor charge (16). Further, it can be appreciated that, with tubes (14) being made of an expandable material, an effective seal can be created just above the anchor charge (16).

Figure 2F:
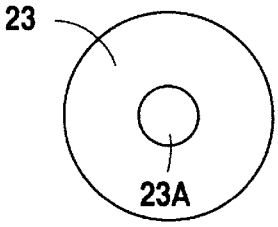
FIGS. 2F and 2G are side and top elevational views, respectively, of the cap for the tube container of Applicant's present invention.
Figure 2G:
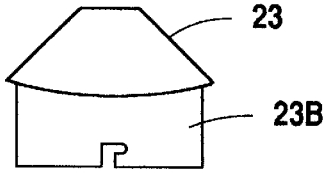

FIGS. 2F and 2G illustrate a cap for using on tube loader after the tubes have been loaded therein. Specifically, loader cap (23) has a conical shape section with a hole (23A) at the apex thereof to release any vacuum buildup in the tube. The conical section terminates at walls (23B) dimensioned to fit snugly within the tube loader body. Just within the tube loader body are mounting bosses (23C) that will engage L-shaped slots (23D) in walls (23B) of the cap. The cap is placed on the tube loader after the tubes have been loaded therein.

Figure 3A:
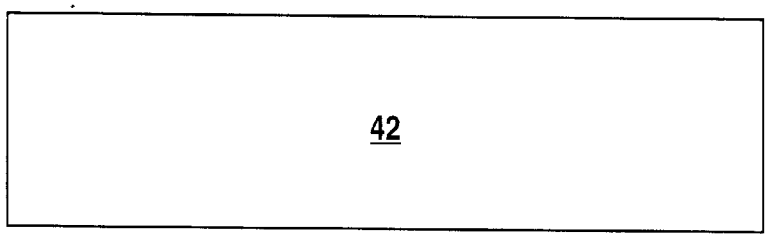
FIG. 3A is a top elevational view of a sheet-like material used to make a tube.
Figure 3B:
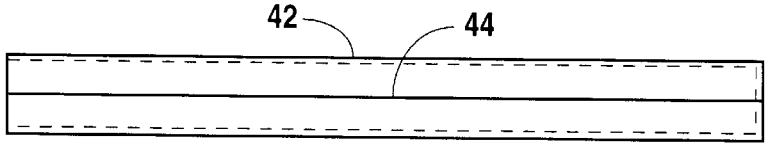
FIG. 3B is a side elevational view of the tube formed by the sheet of FIG. 3A.
Figure 3C:
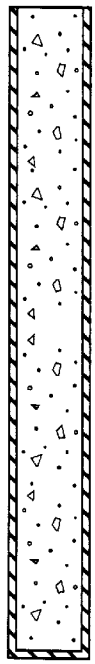
FIG. 3C is a cross-sectional side view of the tube filled with the liquid swellable material.

Turning now to the details of tube or tubes (14) and with reference to FIGS. 3A, 3B, and 3C, a tube covering can be selected from a sheet-like material (42) which would be soluble in water, and may be paper, more specifically, may be a water-soluble paper, such as that available from the National Starch and Chemical Company of Bridgewater, N.J., under the product name Binder WS, Product No. 53-0815. Sheet (42) can be cut into various lengths (usually from 12 inches to 3 feet) and will determine the length of the tube. It can be cut into various widths (usually from 3 to 12 inches), depending upon the diameter of the tube loader. Typically, the sheet length is 2 to 3 feet, and the sheet width can be up to 8½".

Figure 3D:
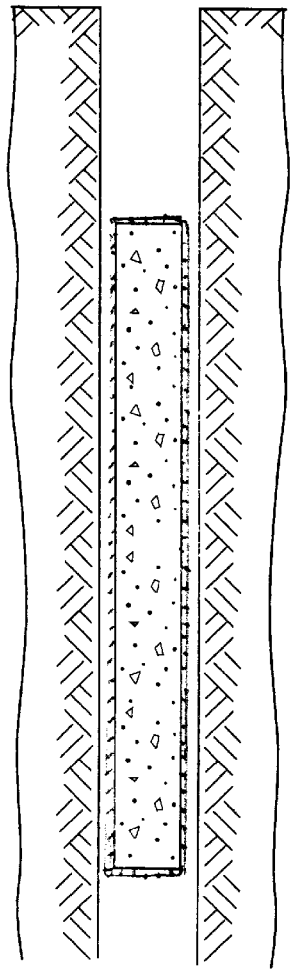
FIG. 3D a straight and side elevational view of the tube as its moving downward within a shot hole.

FIG. 3D illustrates that rectangular sheet (42) is rolled into a tubular shape and glued at seam (44). One end is crimped and sealed with water or glue. FIG. 3C illustrates that the cylinder created and illustrated in FIG. 3B is filled, through the uncrimped or open end, with a liquid-swellable clay or other material, or a combination of liquid-swellable materials (46). A typical liquid-swellable clay is bentonite, which can be used straight or can be combined with barite to increase the specific gravity of material (46), a typical bentonite/barite combination being in the range of 80% to 90% bentonite to 20% to 5% of barite. Other liquid-swellable materials include one or more of the following materials or combinations thereof: gel (a powdered bentonite) and Dispac®. Barite is added to increase the specific gravity of the material added to the tube to assist in sinking the tube in shot holes where the mud suspension is especially thick (high specific gravity).

Following filling of tube (14) with liquid-swellable material (46), the open end is sealed and crimped. Prior to its use, the tube may, optionally, be coated (for example by immersion) in liquid vegetable oil, such as that sold under the brand name Crisco®. The emersion of the tube in vegetable oil delays the dissolution of the tube sheet (42). Another vegetable oil that may optionally be used to coat tube (14) is LouAna®. The purpose of coating the tube is to delay the dissolution of the tube until it reaches the desired location in the hole.

The tube is made typically of a biodegradable material and may be made in various lengths of 12" to 30" and in diameters of 1" to 2½". The tube is designed with sheet material to dissolve, allowing the liquid-swellable clay to take up the mud suspension fluid, swell up and seal the shot hole, all after being deposited by the tube loader which is retracted from the hole, leaving the tube or tubes on top of the loader anchor which has the charge attached to it. At an appropriate time, liquid-swellable material sets as a plug and the charge may be detonated. In a preferred embodiment the tube is used without the loader, that is, just dropped into the shot hole following the charge.

Terms such as "left," "right," "up," "down," "bottom," "top," "front," "back," "in," "out," and like are applicable to the embodiments shown and described in conjunction with the drawings. These terms are merely for purposes of description and do not necessarily apply to the position or manner in which the invention may be constructed for use.

Moreover, the use of the term mud suspension includes water and water-mud suspensions.

Although the invention has been described in connection with the preferred embodiment, it is not intended to limit the invention's particular form set forth, but on the contrary, it is intended to cover such alternatives, modifications, and equivalences that may be included in the spirit and scope of the invention as defined by the appended claims.

What is claimed is:

1. A method for sealing a drilled shot hole, the shot hole at least partially filled with a mud suspension and having a first end open to a ground surface and a removed end beneath the ground surface, the steps of the method commencing after a shot charge is inserted into the shot hole the method comprising the steps of:

providing a container carrying an expandable material and having a cover, the cover including a composition soluble in the mud suspension;

locating the container of the providing step at a removed end of the shot hole by releasing it into the first end of the shot hole and allowing it to settle to the removed end;

awaiting the dissolution of the cover of the container of the providing step and the expansion of the expandable material of the providing step;

wherein the expansion of the material of the providing step seals the hole at the removed end thereof with the shot beneath the expanded material.

2. The method of claim 1 further comprising the step of adjusting the specific gravity of the container of the providing step until the specific gravity is greater than that of the mud suspension, the adjusting step taking place before the locating step.

3. The method of claim 1, wherein the composition of the cover of the providing step includes paper and the expandable material includes bentonite clay.

4. The method of claim 1 further including the step of coating the cover of the container of the providing step with a material that will delay the dissolution of the cover until the completion of the locating step.

5. The method of claim 4, wherein the material of the coating step is vegetable oil.

6. The method of claim 5, wherein the composition of the cover of the container of the providing step includes paper and the expandable material includes bentonite clay.

7. A device for inserting into a shot hole drilled into the surface of the earth, the shot hole having an open first end at the earth's surface and a closed second or removed end at a point below the earth's surface, the shot hole at least partially filled with a mud suspension, the device comprising:

a plug made up of material that is capable of expanding upon contact with the mud solution of the shot hole and a cover, the material being at least partially enclosed by the cover, the cover being soluble in the mud suspension and the plug dimensioned for receipt into the shot hole wherein the cover is coated with means to delay the dissolution of the cover, wherein the means to delay includes vegetable oil.

8. A device for inserting into a shot hole drilled into the surface of the earth, the shot hole having an open first end at the earth's surface and a closed second or removed end at a point below the earth's surface, the shot hole at least partially filled with a mud suspension, the device comprising: a plug made up of material that is capable of expanding upon contact with the mud solution in the shot hole and a cover, the material being at least partially enclosed by the cover, the cover being soluble in the mud suspension and the plug dimensioned for receipt into the shot hole, the device further including a plug container, dimensioned to receive therein the plug, the plug container capable of insertion into the hole for containing the plug during descent through the mud suspension down to the removed end of the hole, the plug container including means to retrieve the plug container from the shot hole.

9. The device of claim 8 further including an explosive charge and means for engaging the explosive charge to the container for lowering the plug container and explosive charge into the shot hole.

10. A system for inserting into a shot hole drilled into the surface of the earth, the shot hole having an open first end at the earth's surface and a closed second or removed end at a point below the earth's surface, the shot hole at least partially filled with a mud suspension, the device comprising:

a plug made of a material expandable on contact with the mud suspension and having a cover that will dissolve in the mud suspension, the cover capable of preventing contact between the expandable material of the plug and the mud suspension until the cover dissolves in the mud suspension;

a plug container dimensioned for receipt therein of the plug and including means to retrieve the plug container from the shot hole, the plug container, when combined with the plug, having a specific gravity greater than that of the suspension; and an explosive charge for engagement with the plug container when the container is in receipt of the plug.

11. The system of claim 10 further including means to locate the explosive charge in the hole when the plug container carrying the explosive charge and plug is removed therefrom.

12. The system of claim 11 wherein the container includes means for holding the plug therein during decent of the plug container down the shot hole and also including means for releasing the plug when the plug container begins to ascent from the shot hole.

* * * * *